US005490050A

United States Patent [19]

Clark et al.

[11] Patent Number: 5,490,050

[45] Date of Patent: Feb. 6, 1996

[54] EMERGENCY STROBE LIGHT

[75] Inventors: Mark S. Clark, Ft. Lauderdale; Edward I. Nelson, Plantation, both of Fla.

[73] Assignee: ACR Electronics, Inc., Fort Lauderdale, Fla.

[21] Appl. No.: 236,998

[22] Filed: May 2, 1994

[51] Int. Cl.[6] ..... F21V 9/04; F21S 5/00

[52] U.S. Cl. ..... 362/263; 362/200; 362/282; 362/293; 362/322

[58] Field of Search ..... 362/186, 200, 362/187, 263, 284, 277, 278, 280, 282, 293, 319, 320, 322, 281, 324

[56] References Cited

U.S. PATENT DOCUMENTS

| | | | |
|---|---|---|---|
| 1,600,067 | 9/1926 | Retze | 362/319 |
| 2,623,934 | 12/1952 | Bow et al. | 362/281 |
| 4,152,755 | 5/1979 | Trosper et al. | 362/205 |
| 5,014,171 | 5/1991 | Price, III | 362/319 |
| 5,031,080 | 7/1991 | Aikens et al. | 362/293 |
| 5,134,558 | 7/1992 | Williams et al. | 362/200 |
| 5,319,530 | 6/1994 | Kreutzer et al. | 362/282 |

*Primary Examiner*—Ira S. Lazarus
*Assistant Examiner*—Y. Quach
*Attorney, Agent, or Firm*—Malin, Haley, DiMaggio & Crosby

[57] ABSTRACT

A hand-held strobe light which may be used in rescue or emergency operations in peacetime or in a combat zone. The light includes a watertight housing with a high intensity bulb which flashes white light. Interchangeable blue and infrared filters attached to a flash guard body can be used with the bulb for filtering various wave lengths of light spectrum in combat situations and for both 360 degree or line-of-sight transmission.

4 Claims, 7 Drawing Sheets

EMERGENCY STROBE LIGHT

BACKGROUND OF THE INVENTION

1. Field of the Invention

The present invention relates to portable emergency lights, and more particularly, to a self-contained, hand-held strobe light and distress marker which may be used with various light filters to alert friendly emergency rescue personnel in a combat environment.

2. Description of the Prior Art

Strobe lights have been used for many years in order to make persons or objects more visible. The strobing effect of the light, particularly at night, draws an observer's attention directly to the light. In night time emergency situations, this effect is very beneficial since persons in need of rescue often require prompt response from rescue personnel. Locating a person at night in open, desolate terrain, desert, forest, jungle, or at sea is difficult, often because of the sheer size of the area that must be searched. The use of a strobe light enables emergency personnel to reach persons much more quickly since a bright, flashing strobe is very noticeable in any weather condition.

Portable strobe lights have been used by aviators for many years. Military aviators often operating over large ocean expanses or remote, desolate terrain have found the use of small strobe lights extremely effective in locating downed personnel. However, because the strobe light is visible in all directions, the use of such a light in a combat environment in enemy or hostile territory would also direct enemy forces to a downed aviator. Additionally, a bright flash might also be misinterpreted as a gun muzzle flash which could draw aircraft or ground fire. All of these disadvantages have indicated that there is a need for a small, lightweight, watertight, portable strobe light which may be used with one or more filters and which can be operated from a single, self-contained battery-operated source.

The present invention provides a portable, hand-held emergency strobe light that can be used in both combat and non-combat environments. An encompassing light shield and light filters, employed with a conventional strobe light, can be used to direct light rays along a line of sight and to block certain segments of the visible light spectrum so the emitted light rays may appear as a single distinctive color, often detected only with specialized equipment.

SUMMARY OF THE INVENTION

The present invention is directed to a portable strobe light for use in emergency or distress situations for locating personnel in both combat and non-combat environments. The light includes a flashing xenon bulb and a transparent or clear, water-protective bulb cover contained at one end of a small, hand-sized housing. The xenon bulb emits a bright, white light through the clear cover, and flashes approximately one flash per second. A self-contained power source (battery) within the housing powers the bulb and associated circuitry while a manually-actuated, sparkproof switch lever mounted outside the housing actuates a switch controlling the electronic strobe circuit inside the housing.

The light includes a permanently mounted flash guard, slidably mounted to the exterior housing, having a positionable peripheral light shield and two different light filters, each of which may be positioned over the strobe light by manual manipulation of the flash guard to provide different light emission wave lengths and directional profiles.

The light has three different operating modes, i.e. white only, infrared only or blue only. The first light filter acts to block all visible light below infrared frequencies. The second filter inside the flash guard is used independently of the infrared filter to block all but blue light. When the blue filter is in use, the flash guard on the housing is positioned so that a peripheral light shield around the xenon bulb creates a tunnelling effect to block peripheral transmission of the blue light, in a line-of-sight manner, for manual aim in a desired direction.

The strobe light housing is constructed of a rigid plastic material that is watertight and is substantially rectangular in shape, having the xenon bulb mounted at one end underneath a clear, watertight plastic bulb cover. A manually operated, slidable on/off switch actuator is mounted externally on one face of the housing, and is a waterproof switch that connects the battery to the strobe light bulb through internal circuitry. Without the flash guard, the strobe light would operate in a normal fashion, providing pulsed, high intensity white light in a 360° area, hemispherically surrounding the strobe light when activated.

The flash guard, in accordance with the present invention, is a rectangular, hollow body that permanently fits slidably over the exterior portions of the strobe light housing while still exposing the on/off switch actuator. The flash guard, once installed on the housing, is non-removable. The flash guard has a storage or stored position in which the infrared filter forms a light seal over the clear protective cover of the strobe bulb. If the light were accidentally turned on in the storage position, only infrared rays would be emitted, unobservable by human beings. The shape and configuration of the infrared lens allows for a snug fit above and around the clear bulb cover in the storage position. The peripheral edges of the infrared filter overlap inwardly into the body of the flash guard, forming a light seal around the edges. In the flash guard storage position, the flash guard body and IR filter is mechanically locked in place and can be moved only by deliberate manual manipulation to change operation modes.

The flash guard has an external, movable infrared filter that covers the clear bulb cover in the storage mode and allows only infrared light to pass from the strobe light, and an internal, 90° movable, spring-loaded, blue light filter that can be positioned over the white strobe light when the flash guard body is moved to a particular position longitudinally relative to the strobe light housing. Thus, the flash guard body is moveable longitudinally to provide multiple positions for manually providing different light frequencies and area distribution, depending on the situation.

The present invention allows for three different light-emitting conditions for the strobe light viz. white, blue or infrared light. In the flash guard storage position, the exterior IR filter on the flash guard covers the white strobe light and bulb cover with an infrared filter, such that only infrared light is allowed to pass through the filter. In many military and combat environments, the use of infrared equipment is well known, including infrared detectors that are used at night for locating various objects. The IR filter can be rotated manually 90° from the flash guard stored position to a position out of the way of the white strobe light to provide a white light operating condition. In the white light operating position, the white light is prominently displayed and exposed outside of the flash guard for normal operation emitting white light, 360° peripherally and 180° elevationally. The blue filter operating position is achieved by sliding the flash guard body relative to the strobe light housing, causing the blue filter to move into position over the white strobe light and bulb cover within the flash guard body passage which acts as a peripheral shield. In a combat situation, a downed aviator, for example, could use the infrared filter in the storage position and direct IR rays in the direction of a helicopter or other equipment known to have infrared detecting equipment. The infrared detector operator could then observe a pulsing, infrared signal, not visible to the human eye in the area. This could be useful in peacetime or combat situations. Inside the flash guard body, when moved to the blue filter position, a dark blue light filter allows only dark blue light to pass in a line-of-sight fashion from the top opening of the flash guard. This would be highly directional by the person holding the light, and could be directed in a known direction of friendlies, who could observe and expect to see a blue light, indicating friendly downed personnel. Such a line-of-sight method could also be directed at overhead aircraft if the downed person realized that they were friendly aircraft looking for the downed person. The blue light would positively identify the person and would not be confused with muzzle flashes from firearms. Also, surrounding personnel would not be able to see the blue light because of the shield formed by the flash guard.

Thus, the present invention is capable of peacetime and combat usage, can emit white, strobed light, or an infrared or blue light, shielded, depending on the circumstances, by mere manipulation of a flash guard contained on the strobe light housing.

It is an object of this invention to provide a portable emergency strobe light for locating downed personnel in remote areas that is useful in both peacetime or combat environments through the use of a plurality of different light wave transmissions.

It is another object of this invention to provide a strobe light for emergency location of downed personnel that includes a flash guard to allow directionality and light wave selection for use in a combat environment for location of personnel.

It is still another object of this invention to provide a strobe light having three different individual modes of light transmission and emission, including white light, or infrared light, or blue light that can be directed in a particular line of sight, all modes using the same strobe light source.

And yet still another object of this invention is to provide a highly efficient, hand-held, portable strobe light that includes combat and non-combat operating modes, including a flash guard filter that is easily manipulated manually for changing circumstances.

In accordance with these and other objects which will become apparent hereinafter, the instant invention will now be described with particular reference to the accompanying drawings.

DESCRIPTION OF THE PREFERRED EMBODIMENTS

Figure 1:
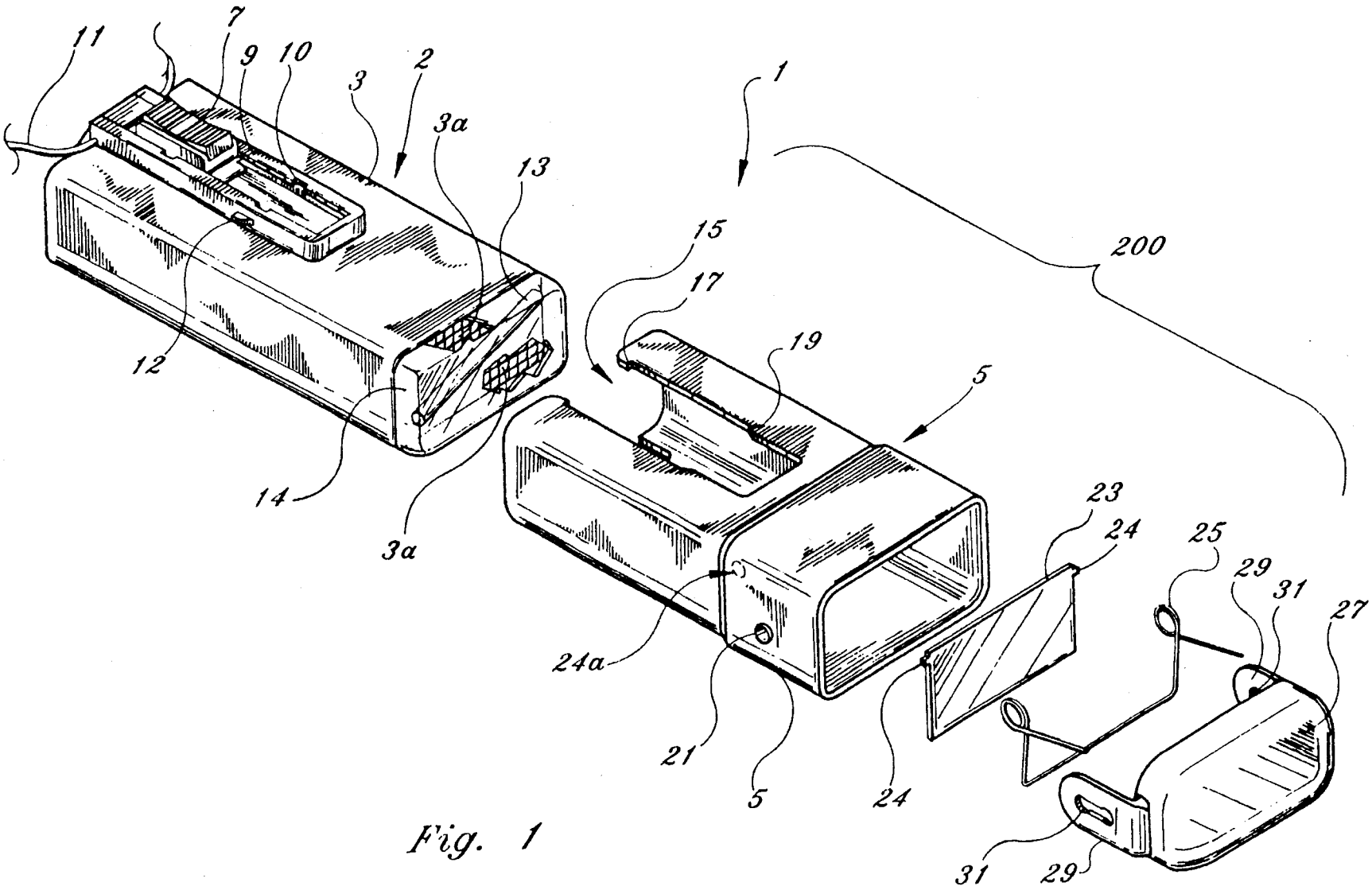
FIG. 1 is an exploded perspective view of the strobe light, including flash guard, showing the present invention.

With reference to FIG. 1, the invention 1 is shown comprising a strobe light 2, and depicts each of the components in an exploded format. The strobe light 2 is comprised of a main exterior housing 3, and a clear, watertight, transparent bulb cover 14. The housing 3 is manufactured of a durable, polycarbonate plastic, and may be colored brightly, such as bright orange or the like, for ease in detection. Alternatively, housing 3 may be colored black or olive to insure the unit's stealth. The main housing 3 includes a waterproof, manual light activating switch actuator 7 for activating an internal strobe light bulb electrical circuit shown in FIG. 9. Switch actuator 7 is a sparkproof magnetic switch which will neither spark nor ignite combustible gases or fuels when actuated. This feature is critical in the event of an aircraft or boating accident where a flammable gas or liquid may be on or near the user hand-held rescue light.

Housing 3 includes a switch guide and retainer channel 9 for sliding longitudinal movement of the switch actuator 7 therein between "on" and "off" positions of the light bulb. Four switch actuator detents 10 act to hold a retaining pin (not shown) attached to a lower portion of the switch actuator 7 within switch guide 9. These detents 10 hold switch actuator 7 into a respective on or off position. A lanyard 11 passes through an aperture at the lower end of switch guide 9 and is used to attach the strobe light 1 to the hand or other fixed object.

At the upper end of the strobe light housing 3, a flash lamp or xenon light bulb 13, as seen in FIG. 1, is connected to a fixed panel 3*a*, having a reflective surface. Flash lamp 13, when actuated by the flash circuit, emits approximately 250,000 peak lumens per flash at an initial flash rate of 60 FPM ±10 FPM. Flash lamp 13 is a xenon bulb or the like, and emits a white, visible light at a frequency range between approximately 4,000 and 7,700 Å. The visibility of flash lamp 13 exceeds one nautical mile on a clear, dark night. At the top of flash lamp 13, a clear, transparent cover 14 allows light transmission through the cover 14 while guarding the bulb 13 against damage due to moisture or collision with foreign objects.

Figure 7C:
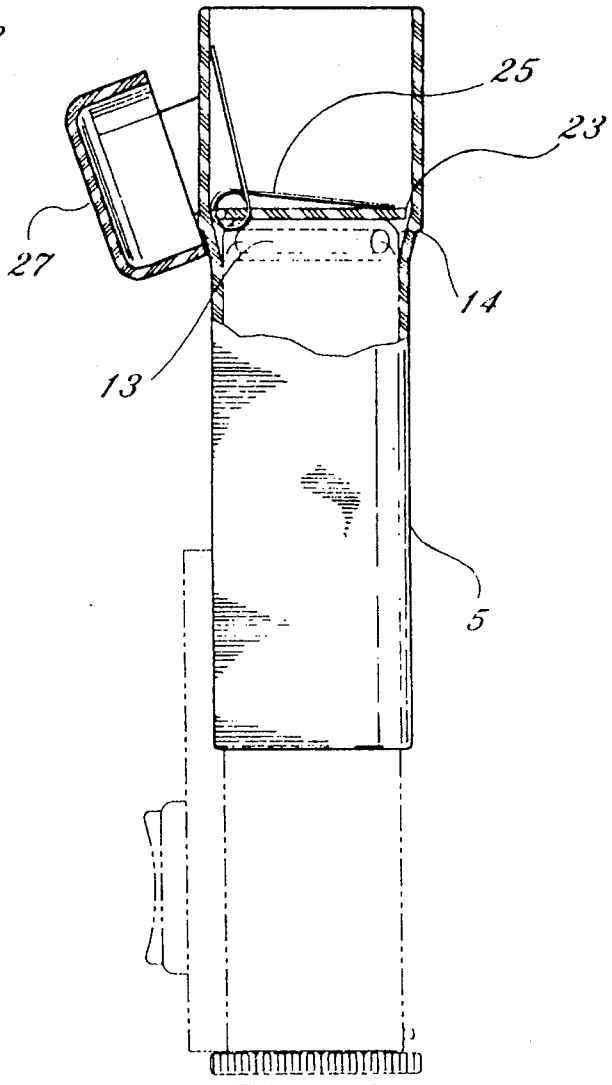
FIG. 7*a*, 7*b*, and 7*c* are side elevational views of the strobe light and flash guard, partially in cross section, showing the blue lens transitionally moving from its spring-loaded, stored position through a partially extended position to fully extended position.
Figure 7B:
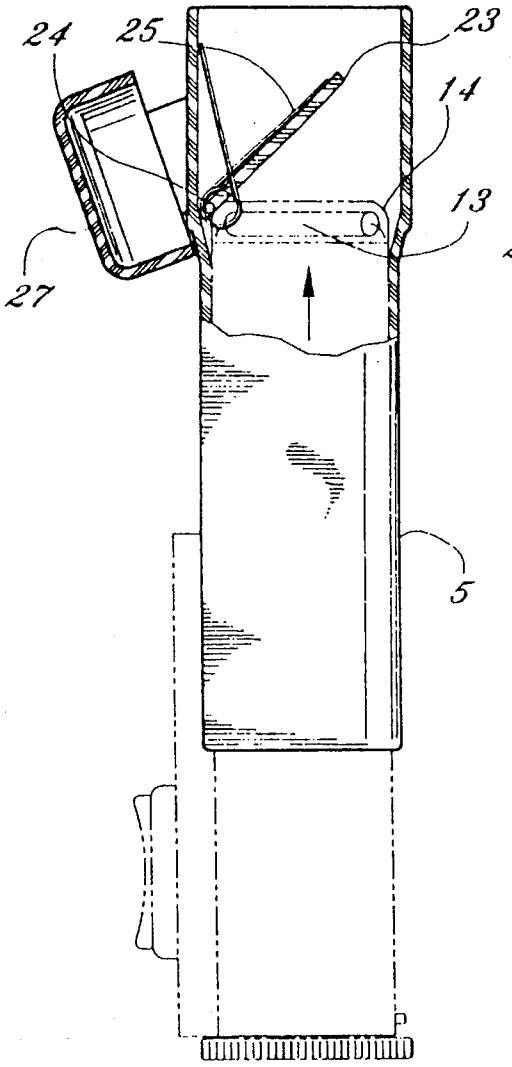
Figure 7A:
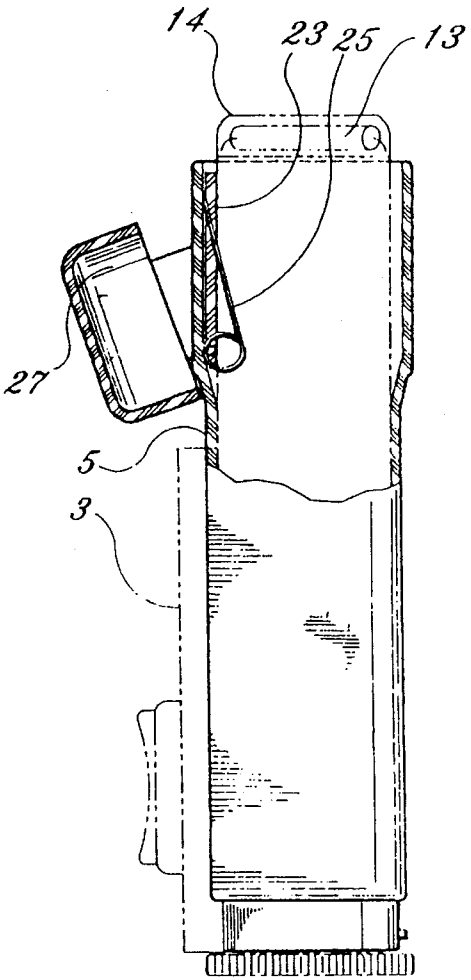

The strobe light housing 3 fits within the hollow passage 15 of flash guard 200 and flash guard body 5. The flash guard and its light filters are movable relative to the strobe light housing and bulb between three different operating positions, explained below. Switch guide 9 fits within a cut out area on one face of flash guard body 5, so that the switch actuator 7 protrudes above the flash guard body surface. The flash guard body 5 also has an internally mounted blue light filter 23 along with spring 25 that pivotally moves translucent plastic blue light filter 23. The blue filter 23 includes hinges 24 which protrude and allow the filter 23 to pivot in a pair of corresponding recesses 24*a* within the flash guard body 5. As best seen in FIGS. 7*a*, 7*b*, and 7*c*, spring 25 forces the blue filter 23 downward over the top of clear cover 14. This occurs when the flash guard body 5 is longitudinally, manually pulled along strobe light housing 3 into an extended position. A second light filter, plastic infrared light filter 27, (hereinafter referred to as IR filter 27) includes rigidly attached support members 29 and corresponding position holding apertures 31. A pair of mounting posts 21 are rigidly attached to the upper portion of the flash guard body 5, one on each side, which fit through and over apertures 31 and allow the IR filter 27 to be manually pivoted about the posts 21 between an operable position when the flash guard is in a stored position, and pivoted to an out of the way position to expose the white or blue light modes.

Figures 4A, 4B, 4C, 4D:
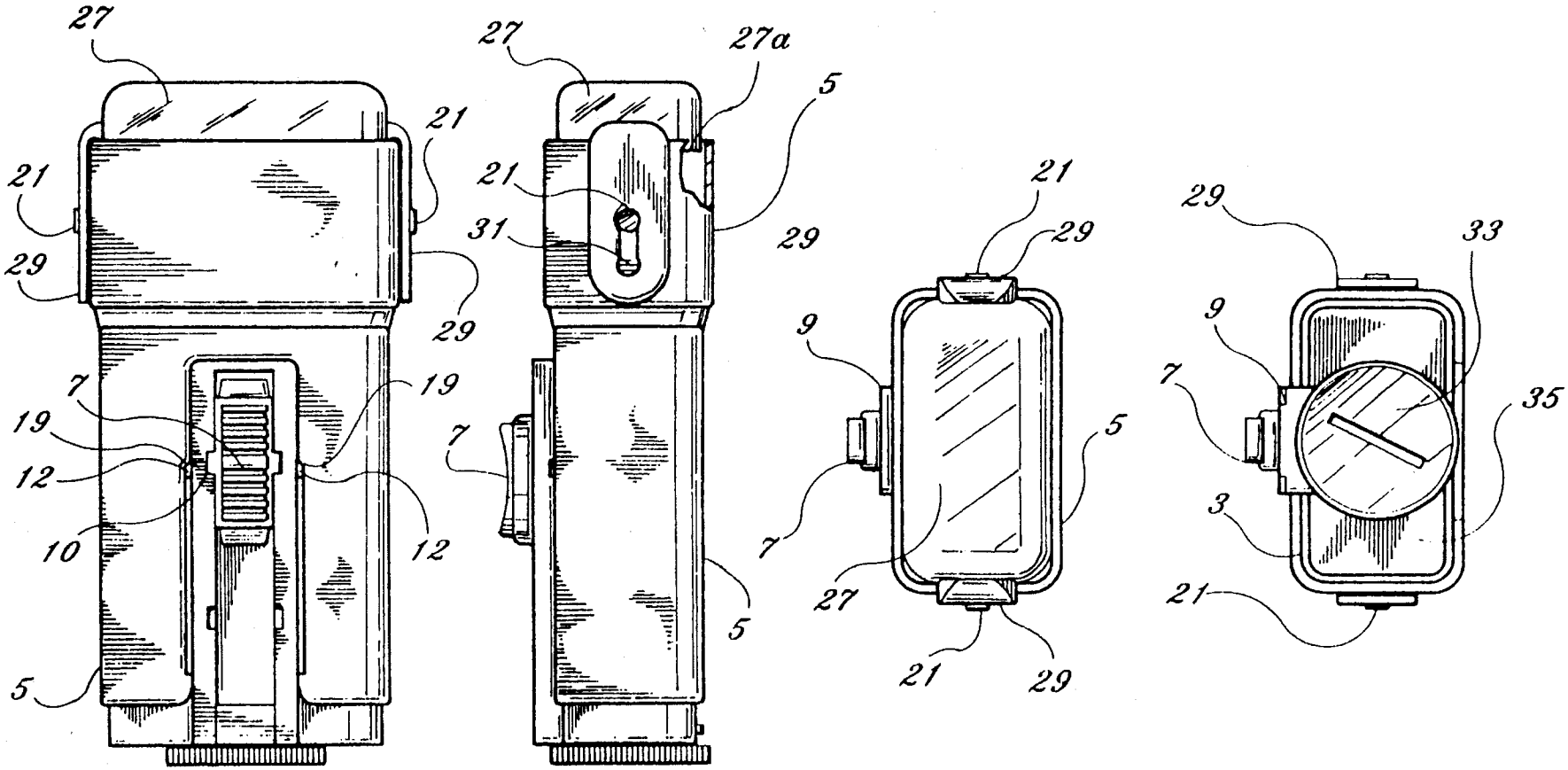
FIG. 4*a* is a front elevational view of the strobe light and flash guard in the retracted position with the infrared lens retracted over the clear lens in the flash guard storage position and IR operation position.
FIG. 4*b* is a side elevational view of that shown in FIG. 4*a*.
FIG. 4*c* is a top plan view of that shown in FIG. 4*a*.
FIG. 4*d* is a bottom plan view of that shown in FIG. 4*a*.

In FIGS. 4*a*, 4*b*, and 4*c*, the strobe light with the IR filter 27 is shown in the flash guard storage or stored position. In the stored position, IR filter 27 rests on top of the flash guard body 5, above and covering bulb 13. As seen in FIG. 4*b*, IR filter 27 and lower edge 27*a* is positioned to overlap below the top edge of the flash guard body 5 to act as a white light seal around the upper edge of the body 5. The flash guard body 5 is not extended. Position barrier tabs 12, extending from the switch guide 9 on each side, press against the upper position detent 19 so the flash guard body 5 cannot be moved toward the strobe light housing base. The IR filter can be used in this position by switching on the light. Only IR rays will be emitted.

Figure 2B:
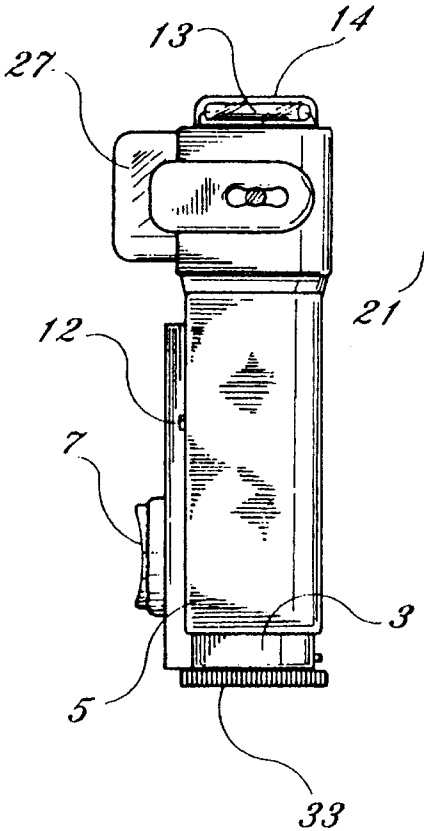
FIG. 2*b* is a side elevational view of that shown in FIG. 2*a*.
Figure 2A:
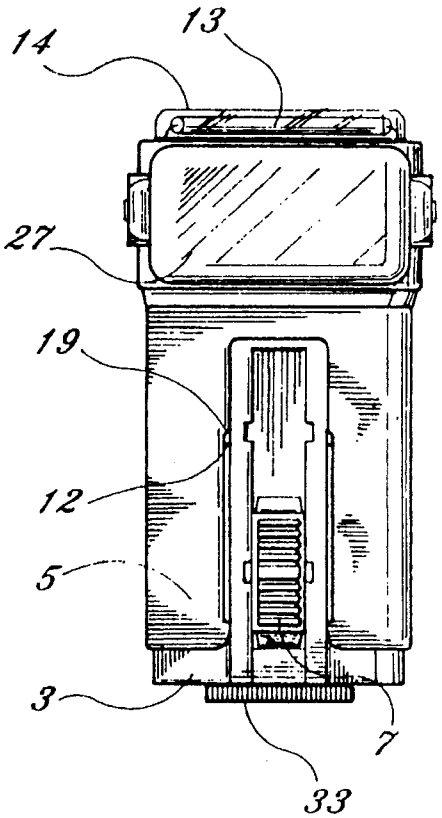
FIG. 2*a* is a front elevational view of the strobe light with the flash guard in its retracted position, and the infrared lens pivoted to expose the white light.

In FIGS. 2*a* and 2*b*, the IR filter 27 has been moved (pivoted) from the flash guard storage position and IR operating position to an out-of-the-way location that exposes white light bulb 13 and clear cover 14. This is the white light operating position.

Figure 3B:
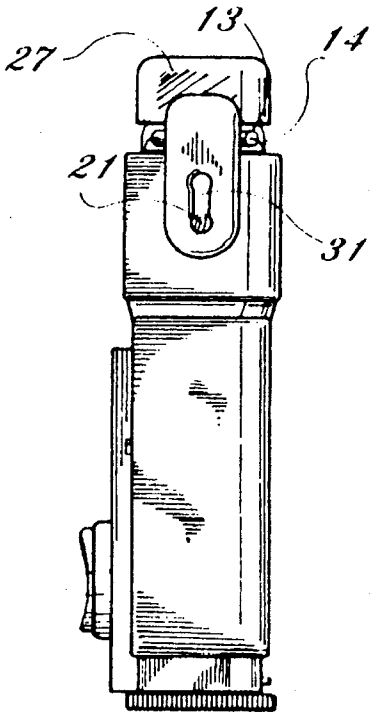
FIG. 3*b* is a side elevational view of that shown in FIG. 3*a*.
Figure 3A:
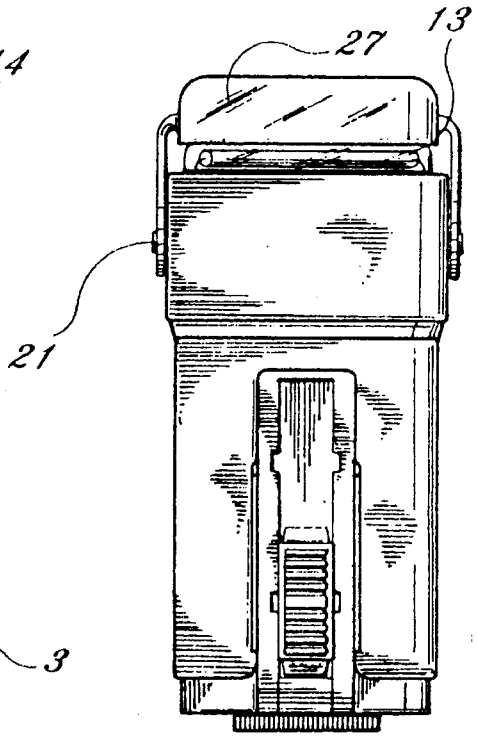
FIG. 3*a* is a front elevational view of the strobe light, with the flash guard in a retracted position, with the infrared lens extended above the clear lens, an intermediate position.

FIGS. 3*a* and 3*b* show the longitudinal extent (manually) of the IR filter 27. The IR filter 27 can be moved from a side position (FIGS. 2*a* and 2*b*) upwardly into an IR operable position directly above, covering the clear cover 14, as shown in FIGS. 4*a* and 4*b*. FIG. 3*b* specifically shows that the mounting post 21 is at the rear of slot 31. Thus, in the IR operating position, the IR filter 27 snaps downward over the clear cover 14. This is best seen in FIGS. 4*a* and 4*b*. FIG. 4*b* shows the mounting post 21 one on each side) at the upper portion of slot 31 after the IR filter 27 has been snapped into the IR emitting operating position. The IR filter 27 lower edge 27*a* overlaps and fits snugly into a recess created by the junction of clear cover 14 and main housing 3. IR filter 27 totally overlaps clear cover 14 to provide a completely leakproof light barrier. Support member 29 also holds IR filter 27 by its frictional engagement with the outer surface of the flash guard body 5. A tight fit is required to prevent visible light emitted from the flash lamp bulb 13 from being emitted around the edges of the IR filter 27.

The IR filter 27 is made of durable plastic and acts to filter visible light below approximately 7,500 Å. As specified above, the IR filter 27 is made generally of a concave shape, and is C-shaped in cross section. This allows a snug fit and overlap that conforms in shape over the clear bulb cover 14 to prevent any visible light from escaping around the edges of the cover 29.

Since the IR spectrum ranges from approximately 7,500 Å to above 36,000 Å, the IR filter 27 filters out visible light below approximately 7,500 Å, allowing only IR frequencies to pass through the filter. Using an IR detection system (not shown), this IR light source can be readily detected. The IR is normally invisible and undetectable to the naked eye, useful in a combat situation. Hence, the strobe light 13, using IR filter 27, can be used by the military or others who wish to avoid detection to all persons except those with IR detection equipment.

FIGS. 4*a*, 4*b*, 4*c*, and 4*d* show the IR filter 27 in its operational position. This is also the compact stored position of the flash guard and the entire strobe light. Switch actuator 7 is shown in its "on" position. FIG. 4*c* shows the IR filter 27 fitting completely over both the flash lamp 13 and clear cover 14. FIG. 4*d* shows the access door to the internal battery compartment (not shown) within strobe light housing 3. A screw member 33 includes an elongated, threaded shaft (not shown) which engages inside the strobe light housing 3 to hold the access door 35 to the battery housing. The battery housing typically holds two AA alkaline batteries, or in the alternative, two AA lithium iron sulfide batteries if a long shelf life is desired. The screw member 33 and rubber gasket (not shown) surrounding the access door 35 insure the battery compartment is tightly sealed and is both vibration proof and waterproof to a depth of approximately thirty meters.

FIGS. 5*a*, 5*b* and 6*a*, 6*b* show the flash guard body 5 in a longitudinally (manually) extended position relative to the strobe light housing 3 required to move the IR 27 filter when it is desirous to use the blue filter 23 and to shield light emission laterally for line-of-sight transmission. The blue filter 23, when moved by a spring over the flash lamp 13, acts to filter out light above approximately 5,500 Å. The blue filter 23 would be used during night time in a combat area for positive identification by a friendly and direct line-of-sight positioning by the user to aim the blue light beam at a friendly aircraft or position without detection by the enemy.

Figures 5A, 5B, 6A, 6B:
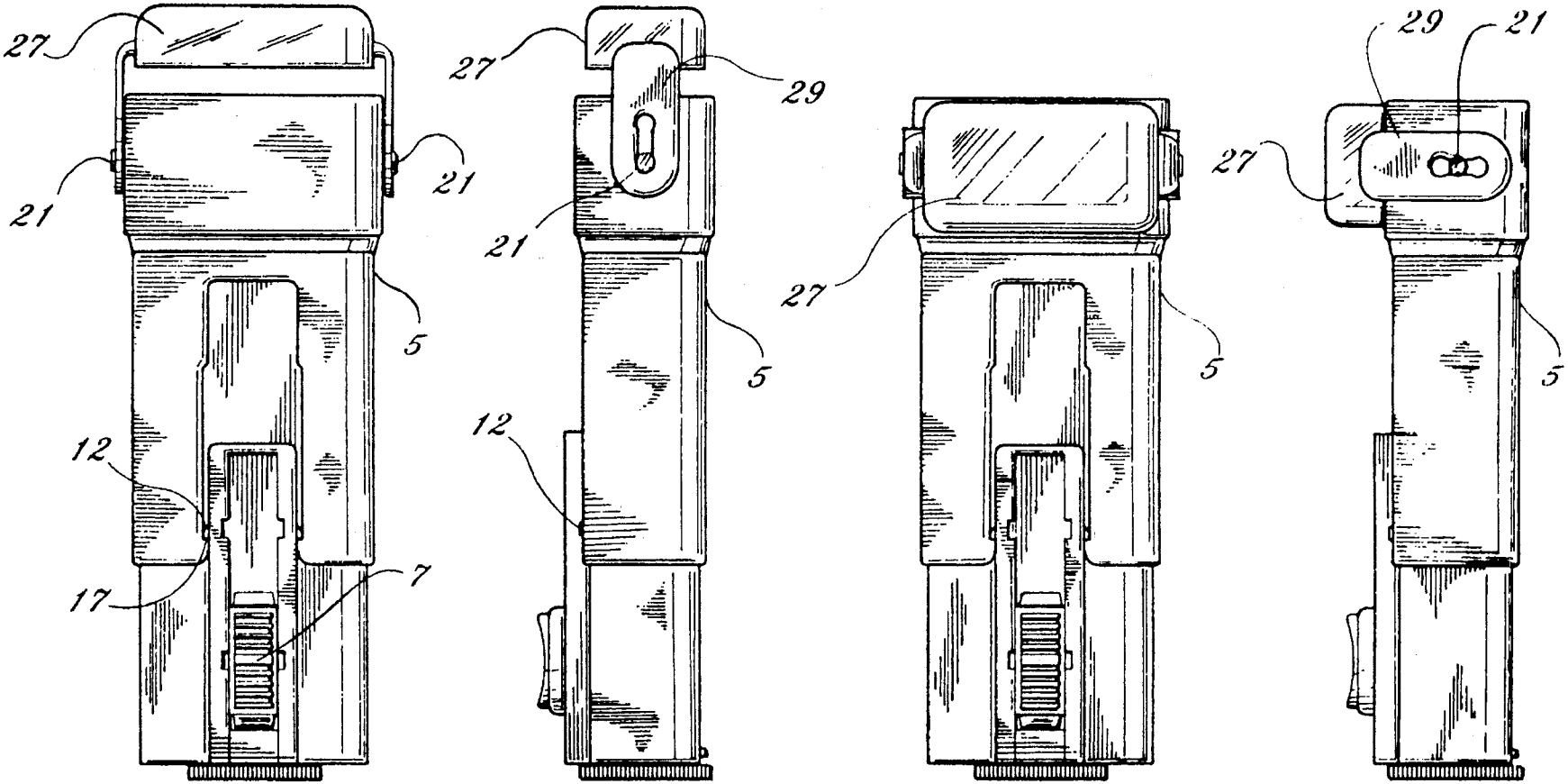
FIG. 5*a* is a front elevational view of the strobe light and flash guard, shown with the flash guard in an extended position, with the infrared lens extended over the clear lens, a non-operable transition position while moving the infrared lens to an out of the way position.
FIG. 5*b* is a side elevational view of that shown in FIG. 5*a*.
FIG. 6*a* is a top view of the strobe light and flash guard, shown extended, with the infrared lens in a non-operable out of the way position.
FIG. 6*b* is a side elevational view of that shown in FIG. 6*a*.

For a white flashing strobe light, the IR filter 27 is manually extended and pivoted about its mounting posts 21 where it is moved out of the way of clear cover 14 and into its stored position as seen in FIGS. 6*a* and 6*b*. As seen in FIG. 6*b*, the IR filter 27 may be positioned flat against the surface of flash guard body 5. The flash guard body 5 stays in the retracted position for use of the white strobe light. Lower position detent 17 prevents the strobe light housing 3 from being totally disengaged and removed from the flash guard body 5.

As seen in FIGS. 7*a*, 7*b*, and 7*c*, when the strobe light housing 3 is extended relative to the flash guard body 5, bulb 13 and clear cover 14 are moved into a position behind the blue filter 23. A portion of spring 25 rests upon the perimeter of blue filter 23 and acts to provide a rotational force, pivoting the blue filter 23 about its hinges 24 as a portion of the strobe housing 3 is moved out of the inside channel in flash guard body 5, freeing the movement of the blue filter. Hinges 24 rotate within associated apertures 24*a* located at each side of the flash guard body 5. Blue filter 23 moves into the position shown in FIG. 7*c* so the lower surface of the blue filter is flush with the upper surface of clear cover 14. The upper portion of flash guard body 5 is moved so that the inner channel encompasses the blue filter to create a lateral peripheral light barrier or tunnel to effect line-of-sight directionality by manually pointing the light in a desired direction. This allows blue light which is emitted from blue filter 23 to be directed to a specific area. In a night combat environment, a friendly can identify the light source while the user can direct the light toward a known friendly aircraft, tank, or area. The IR filter 27 is always moved out of the way when using the blue filter 23.

Figure 8D:
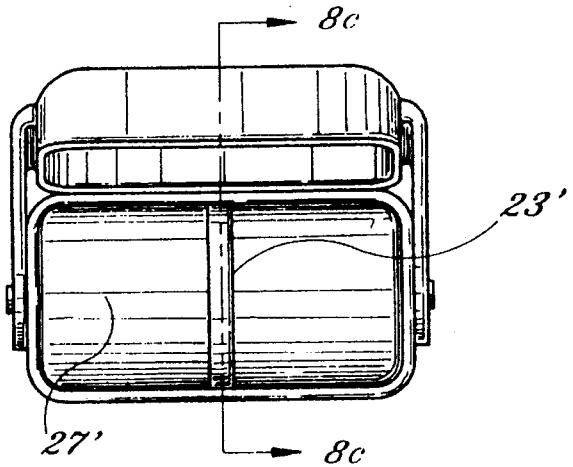
FIG. 8*d* shows a top view of that shown in FIG. 8*c*.
Figure 8B:
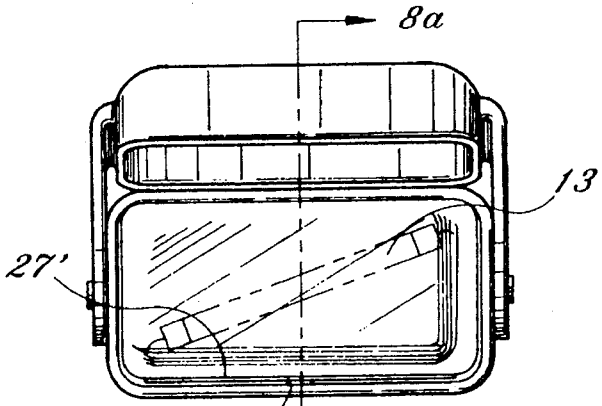
FIG. 8*b* shows a top view of that shown in FIG. 8*a*.
Figure 8A:
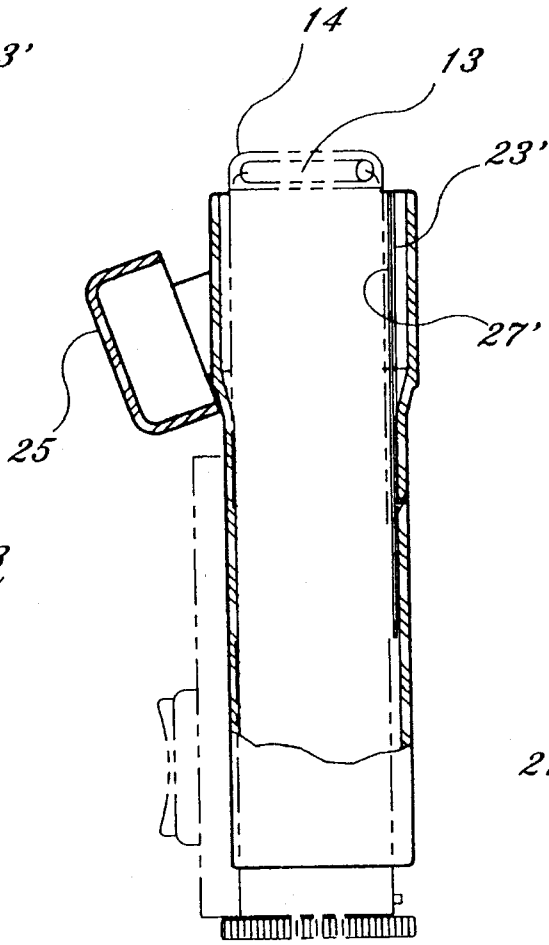
FIG. 8*a* shows a side cross-sectional view through lines VIII*a*–VIII*a* shown in FIG. 8*b* and is an alternative embodiment of the strobe light where the blue lens and spring are stored along a side of the lamp housing.
Figure 8C:
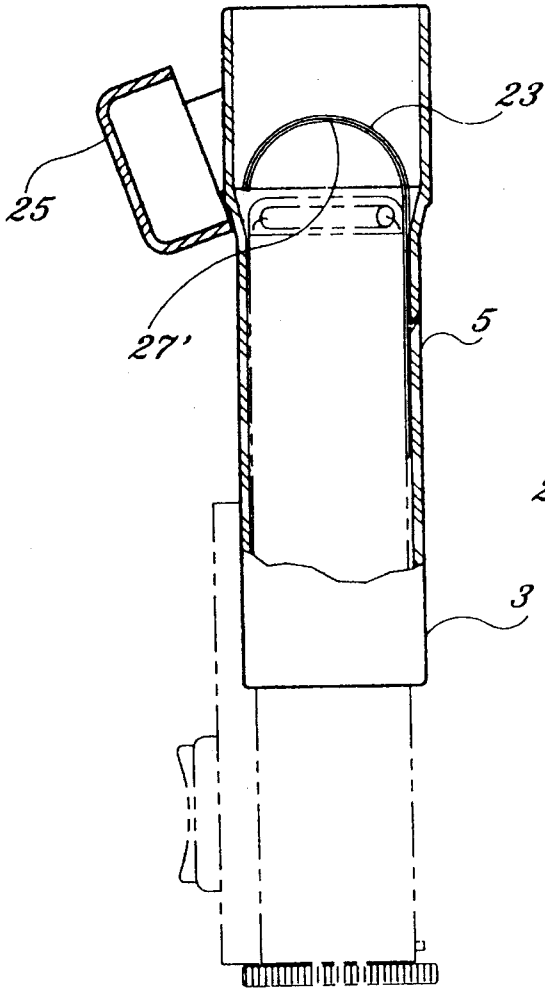
FIG. 8*c* shows a side cross-sectional view of the strobe light through lines VIII*c*–VIII*c* shown in FIG. 8*d* in which the light is in an extended position and the blue lens is bent in a U-shape over the clear cover.

FIGS. 8*a*, 8*b*, 8*c* and 8*d* show an alternative embodiment of the strobe light. In this embodiment, the blue lens 27' is stored in an extended position along the side of strobe housing 3. The blue lens 27' differs from the blue lens in the previous embodiment in that it is relatively thin and pliable, capable of bending and flexing into a U-shape repeatedly without damage. A spring 23' is also positioned adjacent and against the outer surface of blue lens 27'. The spring 23' may be approximately the same length as blue lens 27' and has a narrow dimension so a limited amount of lens area is covered. Spring 23' is typically positioned down the center of blue lens 27' in order to facilitate ease of movement. Alternatively, the spring may be placed at either side of blue lens 27'. FIG. 8*a* shows a side sectional view of blue lens 27', in a stored position, inside of the strobe housing 3. FIG. 8*b* shows a top view of blue lens 27' in its stored position. FIG. 8*c* shows a side sectional view of the extension of housing 3 relative to the flash guard body 5. As flash guard body 5 is moved into position, spring 23' is exposed at the upper portion of flash guard body 5 and tends to bend into its naturally U-shaped position. In turn, the spring 23' forces the pliable upper portion of blue lens 27', which is beneath spring 23', downward. As seen in the figure, blue lens 27' flexes and bends into a U-shape over the top of clear cover 14. FIG. 8*d* shows a top view of spring 23' providing a biasing force to bend blue filter 27' thereby covering flash lamp bulb 13 and clear cover 14. When retracting the flash guard body 5 back into the position shown in FIG. 8*a*, the surface of strobe housing 3 forces both spring 23' and blue lens 27' back into a straight position where it is again stored until its use is required.

Figure 9:
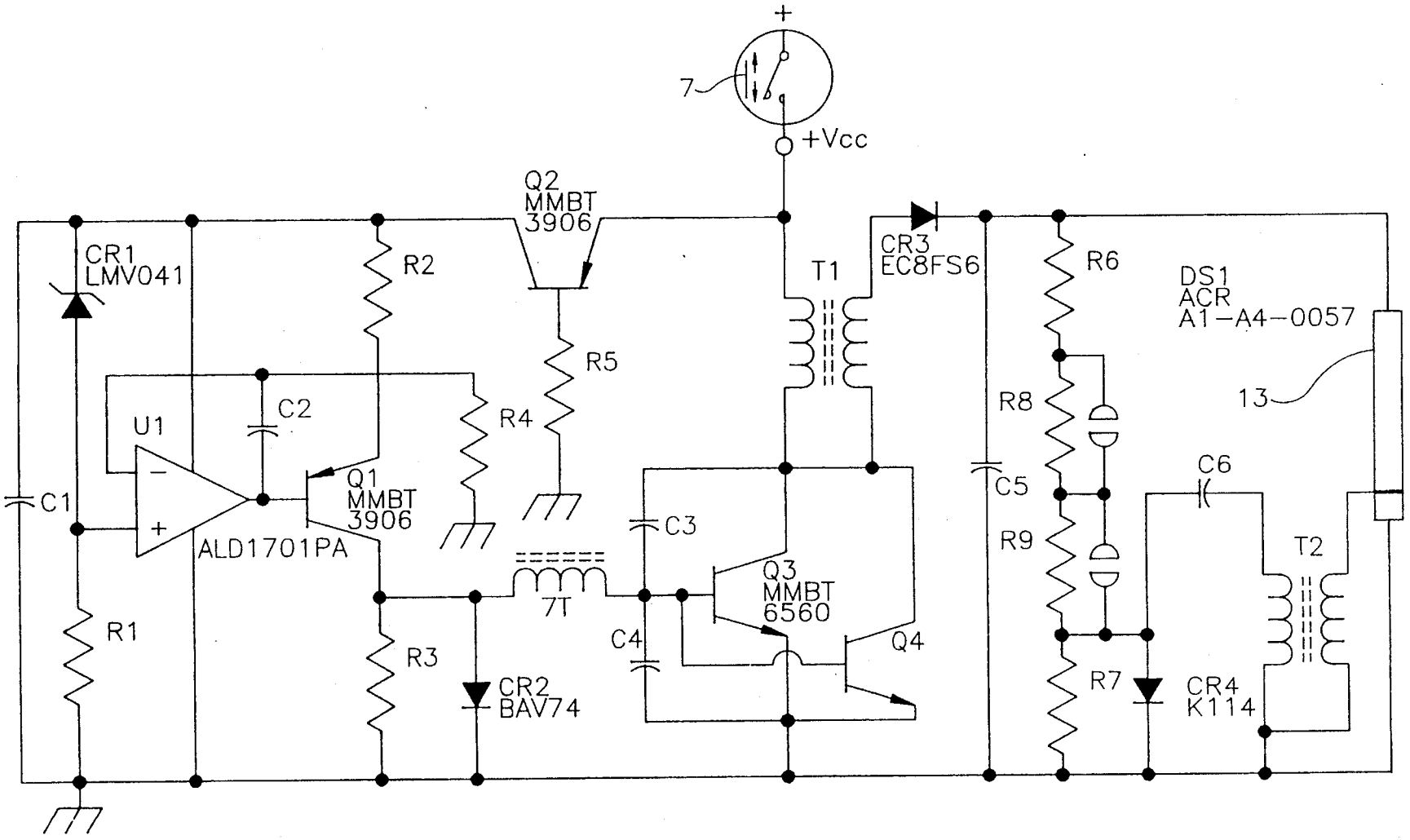
FIG. 9 is a schematic diagram of the strobe light operational circuitry.

FIG. 9 shows the circuit diagram for the strobe bulb 13 activation once switch actuator 7 is positioned to the "on" position. The strobe bulb 13 will pulse in accordance with the circuit parameters. The circuit shown is conventional and includes a trigger coil T2.

The present invention provides efficient, manually-actuated strobe light filters and light guard to allow a white strobe light, used for emergency location purposes, to be converted into a combat useful light that can emit light rays in both the infrared region of the spectrum and in the blue ray region, to allow a person in an emergency situation to be located when in enemy territory or a combat situation. Otherwise, the light can also be used as a normal survival light to find someone at night in remote locations with a strong, white, pulsed strobe light. Using the infrared spectrum in a combat situation, the device can transmit infrared light below the human visible spectrum to infrared detectors used by friendly forces to locate the downed person. Likewise, using a blue light and a tunnel-like shield around the strobe light, a highly directional line-of-sight emission of blue light rays can be transmitted at night in the direction of friendly forces or vehicles to attract attention, known by friendlies to look for a blue, pulsing light. The flash guard, in accordance with the present invention, can be affixed in conjunction with the housing of a white strobe light.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hand-held, portable rescue light for friendly and combat environments, used to locate an individual, comprising:

a strobe light housing, said housing having a light emitting end and an energy cell storage end;

a high intensity strobe bulb for emitting a white light connected to said housing proximate said light emitting end;

a hood in slidable telescopic engagement with said housing, said hood having a first end and a second end, said hood being selectively movable between a retracted position wherein said housing light emitting end extends beyond said hood first end thereby allowing emission of white light substantially hemispherically about said housing light emitting end, and an extended position wherein said hood first end extends beyond said housing light emitting end for shielding light thereby allowing emission of light unidirectionally;

a first light filter pivotally connected to said hood and selectively movable between an operable position wherein said first light filter covers said hood first end, and an inoperable position wherein said hood first end is uncovered;

a second light filter connected to said hood and movable between an inoperable position wherein said second light filter is between said housing and said hood, and an operable position wherein said second light filter covers said housing light emitting end, said second light filter automatically urged to said operable position by a means for biasing, said means for biasing activated by movement of said hood relative to said housing;

at least one energy cell stored in said energy cell storage end and electrically connected to said bulb by an electrical circuit;

said housing further comprising a magnetic two-position switch for selectively activating said electrical circuit to energize said high intensity strobe bulb.

2. A hand-held, portable rescue light as recited in claim 1, wherein said first light filter comprises an infra-red light filter for filtering out light below 7,500 Å.

3. A hand-held, portable rescue light as recited in claim 1, wherein said second light filter comprises a blue light filter for filtering out light above 5,500 Å.

4. A hand-held, portable rescue light for friendly and combat environments, used to locate an individual, comprising:

a strobe light housing, said housing having a light emitting end and a battery storage end;

a high intensity strobe bulb for emitting a white light connected to said housing proximate said light emitting end;

a hood having a first end and a second end, said hood being in slidable telescopic engagement with said housing, said hood and said housing being coaxially aligned, said hood selectively movable between a retracted position wherein said housing light emitting end extends beyond said hood first end thereby allowing emission of white light substantially hemispherically about said housing light emitting end, and an extended position wherein said hood first end extends beyond said housing light emitting end and acts as a light shield thereby allowing emission of light unidirectionally;

a first light filter pivotally connected to said hood and selectively movable between an operable position wherein said first light filter covers said hood first end, and an inoperable position wherein said hood first end is uncovered;

said first light filter consisting of an infra-red light filter for filtering out light below 7,500 Å;

a second light filter connected to said hood and movable between an inoperable position wherein said second light filter is positioned between said housing and said hood, and an operable position wherein said second light filter covers said housing light emitting end, said second light filter automatically urged to said operable position by a means for biasing activated by movement of said hood toward said extended position, said second light filter retracted to said inoperable position by movement of said hood toward said retracted position;

said second light filter consisting of a blue light filter for filtering out light above 5,500 Å;

at least one energy cell stored in said energy cell storage end and electrically connected to said bulb by an electrical circuit;

said housing further comprising a magnetic switch for selectively activating said electrical circuit for energizing said high intensity strobe bulb.

* * * * *